United States Patent [19]

Ozawa

[11] Patent Number: 4,735,407

[45] Date of Patent: Apr. 5, 1988

[54] DEVICE FOR TAKING OUT SHEETS

[75] Inventor: Satoshi Ozawa, Kawasaki, Japan

[73] Assignee: Kabushiki Kaisha Toshiba, Kawasaki, Japan

[21] Appl. No.: 918,321

[22] Filed: Oct. 14, 1986

[30] Foreign Application Priority Data

Oct. 15, 1985 [JP] Japan ..... 60-227728

[51] Int. Cl.[4] ..... B65H 5/22

[52] U.S. Cl. ..... 271/3.1; 271/149; 271/184; 271/225; 271/283

[58] Field of Search ..... 271/3.1, 225, 275, 150, 271/149, 280–283, 184, 185

[56] References Cited

U.S. PATENT DOCUMENTS 4,579,326 4/1986 Pinckney ..... 271/3.1

FOREIGN PATENT DOCUMENTS 2622279 12/1977 Fed. Rep. of Germany ..... 271/280

*Primary Examiner*—Richard A. Schacher

*Attorney, Agent, or Firm*—Finnegan, Henderson, Farabow, Garrett & Dunner

[57] ABSTRACT

A device for taking out sheets comprising a temporary stacking section for temporarily stacking sheets to be transported, a take-out section provided on the take-out side of said temporary stacking section for taking out the sheets one by one, conveyers for transporting sheets taken out from said take-out section, first and second vacuum suction chambers provided on an intermediate portion of conveyers which respectively separate the sheets into a first sheet and a second and following sheets if a plurality of sheets are taken out in an overlapped state by the take-out section, and collecting device for successively supplying the second and following sheets from the second chamber to said temporary stacking section.

5 Claims, 3 Drawing Sheets

DEVICE FOR TAKING OUT SHEETS

BACKGROUND OF THE INVENTION

This invention relates to a device for taking out sheets in a postal matter sorter/stamper, for instance, which takes out sheets of postal matter stacked in a temporary stacking section one after another and transporting the taken-out postal matter to the next processing section.

FIGS. 1 and 2 show a prior art device for taking out sheets of the type noted above. Referring to FIG. 1, postal matter sheet P which has been transported in an upright state from first transport path 1 is temporarily stacked in the upright state in temporary stacking section 2. On the front side, i.e., take-out side, of temporary stacking section 2, there is provided a one-by-one take-out section 5, which is constructed by vacuum suction chamber 3 communicated with a vacuum source (not shown) and porous endless take-out belt 4 driven in frictional contact with the front surface of of the vacuum section chamber 3. At take-out section 5, postal matter P is attracted one by one to take-out belt 4 to be transferred to and transported along second transport path 6. On an intermediate portion of second transport path 6, there is provided separator 9, which includes vacuum suction chamber 7 providing a high suction force and vacuum suction chamber 8 providing a low suction force. Vacuum suction chambers 7 and 8 face each other via second transport path 6. The first postal matter sheet P attracted to vacuum suction chamber 7 is transported along second transport path 6 shown by solid line to a subsequent stamping section (not shown). The second postal matter sheet P′ which is transferred to be overtapped with the first sheet P is attracted to vacuum suction chamber 8, and then separated from second transport path 6 as shown by dashed lines in FIG. 2 to be stacked for collection in stacking section 10 provided in the neighborhood.

In this device, however, the second postal matter sheet P′ which is separated by separator 9 and stacked in stacking section 10 has to be taken out and supplied temporary stacking section 2 again by manual operation of operator.

SUMMARY OF THE INVENTION

The object of the present invention is to provide a device for taking out sheets, which is simple in construction, and in which sheets collected in a collecting section can be automatically supplied to the temporary stacking section again without need of any manual operation.

To attain the above object of the invention, there is provided a collection path, in which, when the second sheet is separated by the separator and collected in a stacking section, the collected sheet is automatically discharged to be supplied to the temporary receiving section again.

DETAILED DESCRIPTION OF THE PREFERRED EMBODIMENT

Figure 1:
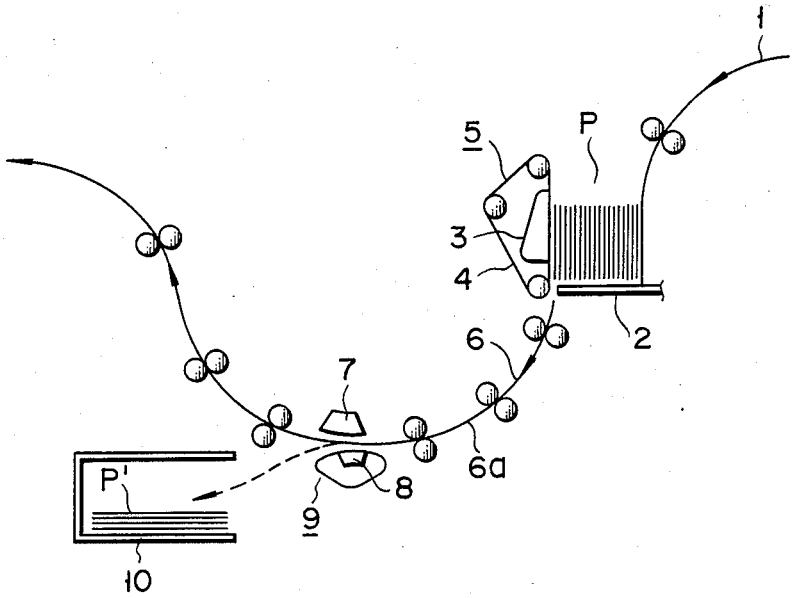
FIG. 1 (PRIOR ART)
FIG. 1 is a schematic view showing a prior art postal matter take-out device.
Figure 2:
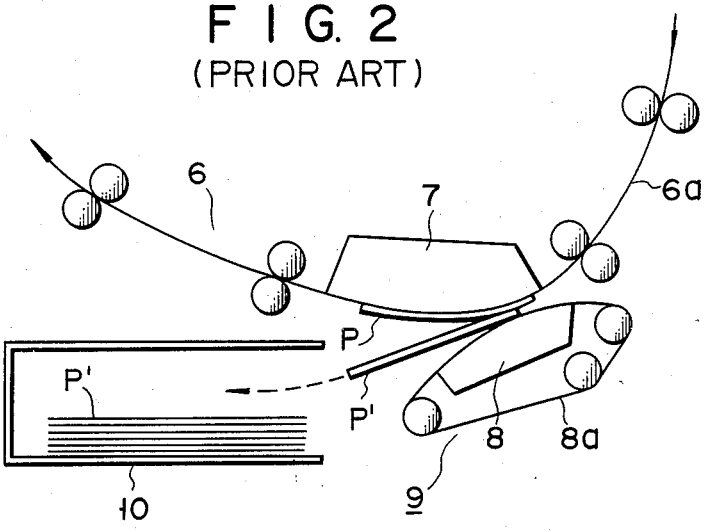
FIG. 2 (PRIOR ART)
FIG. 2 is an enlarged-scale view showing a separator in the device shown in FIG. 1.
Figure 3:
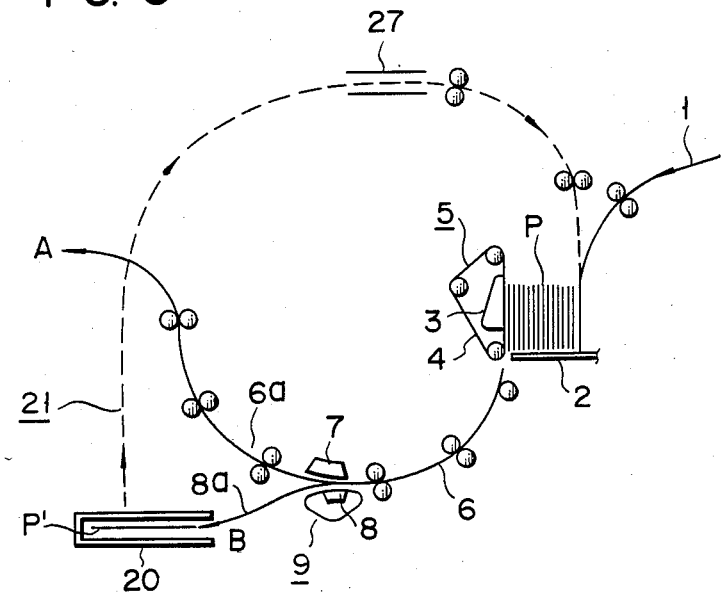
FIG. 3 is a schematic view showing an embodiment of the take-out device according to the invention.
Figure 4:
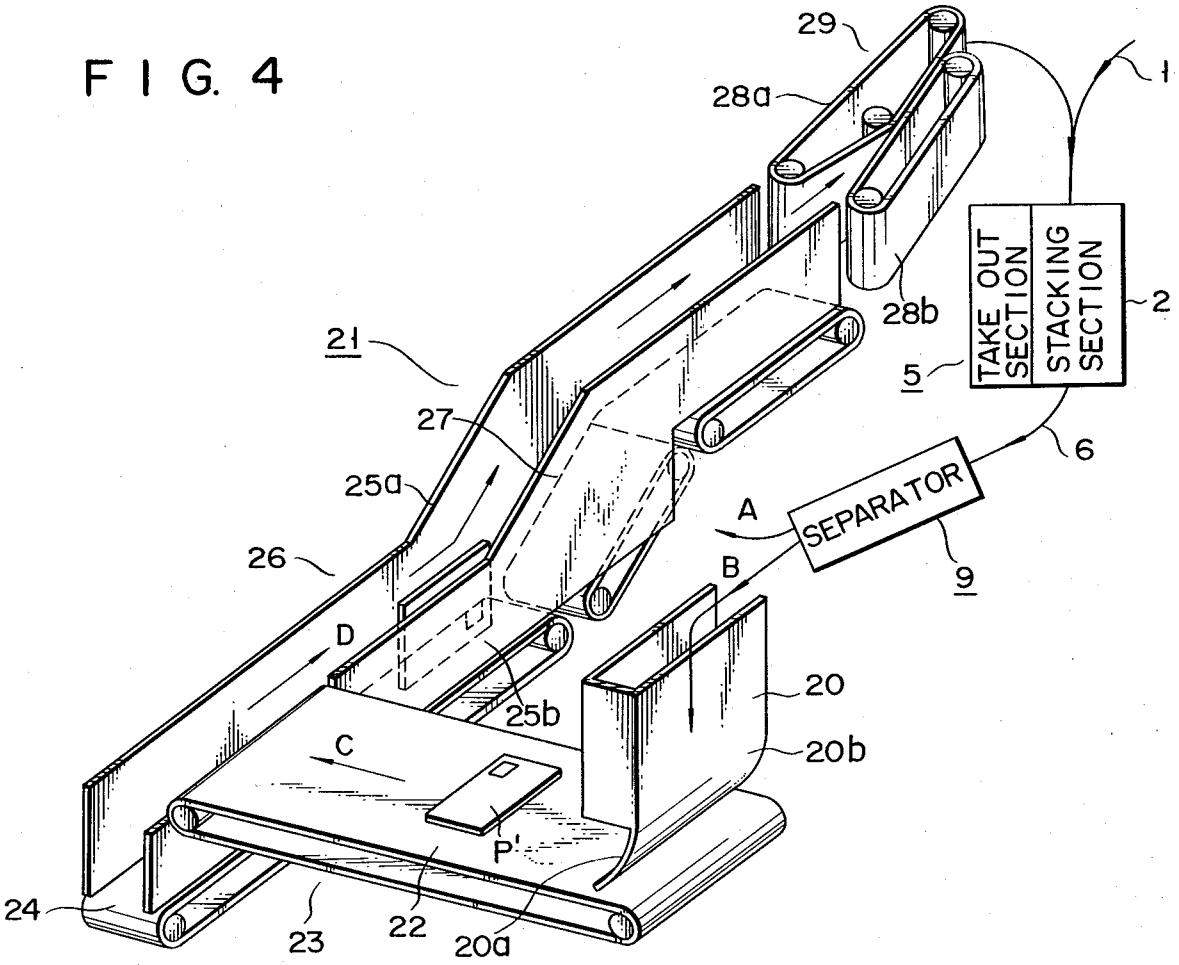
FIG. 4 is a perspective view showing a collecting device in the same embodiment.

The invention will now be described in conjunction with one embodiment thereof with reference to FIGS. 3 and 4. In FIG. 3, reference numerals like those in FIG. 1 designate like parts. Reference numeral 1 designates a first transport path for transporting postal patter P in an upright state. Postal matter P having been transported from first transport path 1, is temporarily stacked in an upright state in temporary stacking or storage section 2. On the front side, i.e., take-out side, of temporary stacking section 2, there is provided a one-by-one take-out section 5, which is constructed by vacuum suction chamber 3 communicating with a vacuum source (not shown) and having suction holes (not shown) provided at the front and take-out belt 4 driven in frictional contact with the front of vacuum suction chamber 3 and having suction holes (not shown) formed at a predetermined interval. As take-out belt 4 is driven, postal matter sheet P is usually taken out one by one in a state attracted to take-out belt 4 to be transported along belt **6*a* which is constructed a plurality of endless belts and constitutes second transport path 6**.

On an intermediate portion of second transport path 6, vacuum suction chamber 7 having a high suction force is provided. Postal matter sheet P having been transported is attracted to the porous endless belt by a suction force of vacuum suction chamber 7 to be transported in the direction of arrow A to a stamping section (not shown) with the running of belt **6*a*. From the consideration of a case when two postal matter sheets are taken out simultaneously by one-by-one take-out section 5, separator 9 is provided such that it faces the front of vacuum suction chamber 7. Separator 9 comprises vacuum suction chamber 8 providing a lower suction force than that of vacuum suction chamber 7 and endless belt 8*a* driven in frictional contact with the front surface of vacuum suction chamber 8 and having suction holes (not shown). The second postal matter sheet P′ which is transferred to be overlapped with first sheet P is attracted to endless belt 8*a* and thus is forcibly separated from the first postal matter sheet P. The separated postal matter sheet is supplied one by one in the direction of arrow B to receiving section 20. Receiving section 20 is not of the prior art stacking section structure described above, in which, after all the transported postal matter sheet P′ is all stacked, it is taken out and supplied to temporary stacking section 2 again by the operator's manual operation. Instead, every time the second postal matter sheet P′ separated by separator 9 is supplied to receiving station 20, it is automatically taken out from receiving section 20 to be collected in temporary with reference to FIG. 4, receiving section 2 via collecting device 21. Stacking section 20 includes box-like member 20*b* open at the front, top and bottom sides and has curved guide member 20*a* depending from the lower end of one side of box-like member 20*b*. Postal matter sheet P′ having been transported in the upright state from the separator 9 to receiving section 20 is allowed to fall through the boxlike member onto guide member 20*a*. At the guide member 20*a***, the postal matter sheet is rendered into a horizontal state.

Collecting device 21 comprises first path 23, second path 26, and third path 29. First path 23 is constructed by endless transport belt 22 having one end disposed beneath receiving section 20 so that it can transport received postal matter sheet P' in the horizontal state in the direction of arrow C. Second path 26 extends perpendicular to first path 23 so that its forward end is positioned under the feed-end of first path 23. The postal matter sheet P' having been transported along first path 23 falls onto endless belt 24 of second path 26 to be transported in an upright state in the direction of arrow D. Second path 26 also includes a pair of side belts 25*a* and 25*b*. Second path 26 extending upwardly inclined section 27 includes up to the level of second transport path 6. Third path 29 extends from the feed-out end of second path 26 and is constructed by pair of vertical endless belts 28*a* and 28*b* which face each other so that the distance therebetween is gradually decreased. First to third paths 23, 26 and 29 are driven in a synchronized relation to one another by a driving source (not shown). The operation of the device having the above construction according to the invention will now be described. After postal matter sheet P having been transported from first transport path 1 is stacked in an upright state in temporary stacking section 2, it is attracted to take-out belt 4 of take-out section 5 provided on the take-out side of temporary stacking section 2 to be transported along second transport path 6. Postal matter sheet P is transported past separator 9 provided on intermediate portion of second transport path 6. When a plurality of postal matter sheets are simultaneously taken out by take-out section 5, the first one of the transported postal matter sheets is attracted to belt 6*a* by the suction force of vacuum suction chamber 7 to be transported in the direction of arrow A to the stamping section for processing. Meanwhile, the second and following postal matter sheets P' are attracted to endless belt 8*a* by the suction force of vacuum suction chamber 8 constituting separator 9 to be transported to receiving section 20.

When the second and following, if any, postal matter sheets P' are transported to receiving section 20, they are allowed to fall through receiving section 20 to be guided by guide member 20*a* to be transferred in a horizontal state to endless belt 22 of first path 23 to be transported in the direction of arrow C. When postal matter sheet P' has been transported to the feed-out end of endless belt 22, it falls in an upright state onto belt 24 of second path 26 and is guided in this state by side belts 25*a* and 25*b* to upwardly inclined section 27. Along upwardly inclined section 27, it is elevated up to the same level as second transport path 6. Then, it is transported in the horizontal state again to third path 29. In third path 29, postal matter sheet P' is clamped between endless belts 28*a* and 28*b* to be supplied in this state into temporary stacking section 2 and then to be stacked together with postal matter sheet P transported form first transport path 1. In this way, the postal matter sheet P' is automatically collected. When the collected postal matter sheet P' and transported postal matter sheet P join together, the postal matter sheets may be supplied in an overlapped state into temporary stacking section 2. Thus, the postal matter sheet can be smoothly collected.

In the above embodiment, collecting device 21 is provided beneath second transport path 6 leading to receiving section 20 to collect the second postal matter sheet P'. However, it is also possible to dispose the collecting device above second transport path 6. As a further alternative, it may be disposed such that it does not cross second transport path 6, as shown in FIG. 5.

Figure 5:
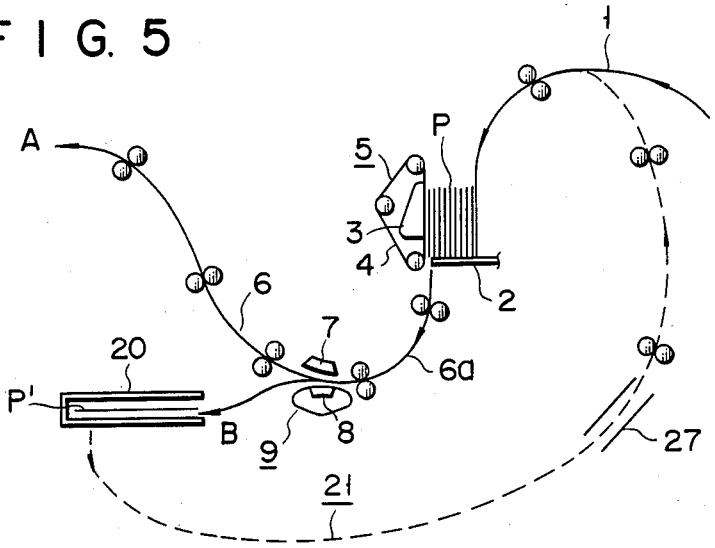
FIG. 5 is a schematic view showing a different embodiment of the invention.

Further, in the case of FIG. 5, it is possible to provide a switch-back mechanism (not shown) instead of receiving section 20, thus forming a collecting device, in which postal matter sheet can be collected without any level change.

Further, a buffer device (not shown) may be provided at a position ahead of the point of joining of the first and second transport paths. In this case, postal matter sheets P' having transported along inclined section 27 are caused to join postal matter sheets P being transported along first transport path 1. Further, where a device having a buffering function is provided ahead of first transport path 1, it is possible to cause postal matter sheet P' from the collecting device to join postal matter sheet P at a position ahead of the collecting device.

As has been described in the foregoing, according to the invention, when a plurality of sheets are simultaneously taken out in an overlapped state by the one-by-one take-out device, the second and following sheets can be supplied again to the take-out device automatically and without need of any manual operation.

What is claimed is:

1. A device for taking out sheets, comprising:

a temporary stacking section for temporarily stacking sheets to be transported;

take-out means provided on the take-out side of said temporary stacking section for taking out the sheets stacked in said temporary stacking section one by one;

transporting means for transporting sheets taken out by said take-out means;

separating means provided on an intermediate portion of said transporting means for separating the sheets into a first sheet and at least one other sheet at times when a plurality of sheets are taken out in an overlapped state by said take-out means; and collecting means for sucessively supplying the other sheets from said separating means to said temporary stacking section.

2. The device according to claim 1, wherein said separating means includes a first vacuum suction chamber having a first suction force for retaining the first sheet on said transporting means, and a second vacuum suction chamber having a second suction force for separating the other sheets from said transporting means, said first suction force being greater than said second suction force, said first and second suction chambers being provided on opposite sides of said transporting means.

3. The device according to claim 1, wherein said collecting means includes a receiving section for receiving the other sheets from said separating means, and transferring means for transferring the other sheets from said receiving section to said temporary stacking section.

4. The device according to claim 3, wherein said receiving section includes a box having front and bottom openings, the other sheets are introduced into said box from the front opening and falling downwardly from the bottom opening, and said transferring means of said collecting means includes belt means for receiving the sheets fallen down from said box and transporting the sheets to said temporary stacking section.

5. A device for taking out sheets comprising:

a temporary stacking section for stacking sheets to be transported in an upright staste;

take-out means provided on the take-out side of said temporary stacking section for taking out the sheets stacked in said temporary stacking section;

transporting means for transporting sheets taken out by said take-out means in an upright state;

separating means provided on an intermediate portion of said transporting means for separating the sheets into a first sheet and at least one other sheet at times when a plurality of sheets are taken out in an overlapped state by said take-out means; and collecting means for successively supplying the other sheets from said separating means to said temporary stacking section, said collecting means receiving the sheets from said separating means in an upright state, transferring the sheets from said separating means in a horizontal state, and supplying the sheets to said temporary stacking section in an upright state.

* * * * *